US011802685B1

(12) United States Patent
Hitt

(10) Patent No.: US 11,802,685 B1
(45) Date of Patent: Oct. 31, 2023

(54) LIGHT-EMITTING DIODE BULB

(71) Applicant: Jason Hitt, Burbank, CA (US)

(72) Inventor: Jason Hitt, Burbank, CA (US)

( * ) Notice: Subject to any disclaimer, the term of this patent is extended or adjusted under 35 U.S.C. 154(b) by 0 days.

(21) Appl. No.: 17/968,205

(22) Filed: Oct. 18, 2022

(51) Int. Cl.
*F21V 23/06* (2006.01)
*F21V 23/00* (2015.01)
*F21Y 115/10* (2016.01)

(52) U.S. Cl.
CPC ..... *F21V 23/06* (2013.01); *F21V 23/001* (2013.01); *F21Y 2115/10* (2016.08)

(58) Field of Classification Search
CPC ..... F21V 23/06; F21V 23/001; F21Y 2115/10
See application file for complete search history.

(56) References Cited

U.S. PATENT DOCUMENTS

2013/0201658 A1* 8/2013 Bogart ..... F21V 15/00 362/95
2016/0091196 A1* 3/2016 Chien ..... F21V 33/0004 362/253

* cited by examiner

*Primary Examiner* — Mary Ellen Bowman
(74) *Attorney, Agent, or Firm* — Vladimir Postnikov

(57) ABSTRACT

Disclosed in the present invention is a light-emitting diode (LED) bulb having connectors that can enable the user to swap the power source or change the light LED bulb without having to cut the wire. LED bulb comprises a power source and a light bulb connected to the power source through a pin and cables. The power source further comprising a wire that has connector piece at end. The light bulb further comprising a wire that has connector piece at end. The electrical construction is designed in such a way that if the wiring has a pin connector, the wires can be separated without having to use a tool or additional parts.

14 Claims, 2 Drawing Sheets

LIGHT-EMITTING DIODE BULB

TECHNICAL FIELD

The present invention generally, relates to light-emitting diode (LED) bulbs and in particular to light-emitting diode bulb having connectors that can enable the user to swap the power source or change the light LED bulb without having to cut the wire.

BACKGROUND ART

Light-emitting Diode (LED) light bulbs have been on the market for sometimes. Generally, a LED lamp or LED light bulb is an electric light that produces light using light-emitting diodes (LEDs). LED lamps are significantly more energy-efficient than equivalent incandescent lamps and can be significantly more efficient than most fluorescent lamps. The most efficient commercially available LED lamps have efficiencies of 200 lumen per watt (Lm/W). Commercial LED lamps have a lifespan many times longer than incandescent lamps.

Early LED lamps varied greatly in chromaticity from the incandescent lamps they were replacing. A standard was developed, ANSI C78.377-2008, that specified the recommended color ranges for solid-state lighting products using cool to warm white LEDs with various correlated color temperatures.[20] In June 2008, NIST announced the first two standards for solid-state lighting in the United States. These standards detail performance specifications for LED light sources and prescribe test methods for solid-state lighting products.

Today, LED lamps require an electronic LED driver circuit to operate from mains power lines, and losses from this circuit means that the efficiency of the lamp is lower than the efficiency of the LED chips it uses. The driver circuit may require special features to be compatible with lamp dimmers intended for use on incandescent lamps. Generally, the current waveform contains some amount of distortion, depending on the luminaires' technology. The LED lamp market is projected to grow from US$75.8 billion in 2020 and increasing to US$160 billion in 2026. LEDs come to full brightness immediately with no warm-up delay. Frequent switching on and off does not reduce life expectancy as with fluorescent lighting. Light output decreases gradually over the lifetime of the LED.

Light emitting diodes are generally semiconductor chips that are mounted in a package and emit radiation in response to an applied voltage or current. These LEDs are used in a number of commercial applications such as automotive, display, safety/emergency and directed area lighting. Recently, a white light emitting lamp was developed which includes a blue light emitting diode and a yellow emitting phosphor.

There are some prior art attempts in LED light bulb industry, including the following:

The US patent number U.S. Pat. No. 8,928,025B2 of 2007 Dec. 20 discloses LED lighting apparatus with swivel connection with one or more swivel connections. The LED lighting apparatus includes a housing with at least one end, at least one light emitting diode extending along the housing and at least one end cap. The end cap has an opening with a sidewall to cap the end of the housing and a surface opposite the opening and spanning the sidewall. At least two pin connectors extend from the surface and are connectable to a standard fluorescent or incandescent light fixture. Various configurations are described such that the housing will rotate within the end caps with application of a rotational force after connection of the pin connectors to the light fixture to adjust the light output direction of the LED lighting apparatus. However, whereas the above prior art discloses a LED lighting apparatus with one or more swivel connections, the proposed invention avails a LED light bulb in which if the wiring has a pin connector, the wires can be separated without having to use a tool or additional parts.

The US patent number U.S. Pat. No. 9,184,518B2 dated 2012 Mar. 2 describes an electrical connector header for an LED-based light configured for replacing a conventional fluorescent light in a fluorescent light fixture comprises: an LED circuit board including at least one LED; a power supply circuit board configured to supply power to the at least one LED; an end cap carrying at least one pin configured for connection to the fixture; a pin connector header including a first body retentively supporting at least one pin connecting lead and configured to engage the power supply circuit board such that the pin connecting lead is positioned to electrically connect the power supply circuit board and the pin; and a circuit connector header including a second body retentively supporting at least one circuit connecting lead and configured to engage the power supply circuit board such that the circuit connecting lead is positioned to electrically connect the power supply circuit board and the LED circuit board. However, while the proposed invention claims a LED light bulb comprising a power source with wire that has connector piece at end and light bulb with wire that has connector piece at end, the above prior art claims a LED-based light configured for replacing a conventional fluorescent light in a fluorescent light fixture, comprising: a LED circuit board; an end cap carrying and pin connector header.

Another US patent publication number U.S. Pat. No. 6,791,259B1 of 13 Mar. 2020 teaches of a solid state illumination system containing a light emitting diode, a light scattering material and a luminescent material. A lamp containing a radiation source, a luminescent material and a radiation scattering material located between the radiation source and the luminescent material is provided. The lamp may be a white emitting lamp. The radiation source may be a blue emitting LED. The luminescent material may be a yellow emitting phosphor or dye. The radiation scattering material may be ceramic particles, such as TiO2 particles, in a carrier medium, such as glass, epoxy or silicone. However, the above prior art relates to a solid state illumination system containing a light emitting diode, a light scattering material and a luminescent material as opposed to the proposed invention which provides a LED light bulb using connectors to swap the power source or change the light LED bulb without having to cut the wire.

Further, fluorescent lights are widely used in a variety of locations, such as schools and office buildings. Although conventional fluorescent lights have certain advantages over, for example, incandescent lights, they also pose certain disadvantages including, inter alia, disposal problems due to the presence of toxic materials within the light.

LED-based lights designed as one-for-one replacements for fluorescent lights have appeared in recent years. These LED-based lights can include a number of electrical assemblies, such as electrical connectors and various circuit boards. Electrical connections are often required between the electrical assemblies in order to permit conveyance of power between them. During manufacture of an LED-based light, these electrical connections may be made by landing wires between the electrical assemblies.

However, wires are typically flexible and may be hard to grasp. Further, undesirable memory may be generated within a wire due to spooling, which causes inconsistencies in the curvature of a given length of wire and sometimes hard to connect. These properties, for example, can make it difficult to position and maintain typical wires in a desired orientation and spacing with respect to the electrical assemblies while making the electrical connections.

Manufacturers of LED-based lights, and in particular manufactures wanting to automate the assembly of LED-based lights, may therefore desire improvements upon the components and processes typically used for making electrical connections between the electrical assemblies.

The present invention solves the above-mentioned problems and provides a distinct advance in the art of LED bulb technology as it provides a user-friendly LED bulb using connectors to swap the power source or change the LED bulb without having to cut the wire and other embodiments.

OBJECTS OF THE INVENTION

The main object of the present invention is to provide a LED light bulb that can swap colours through use of a pin connector.

The other object of the present invention is to provide a LED light bulb that enables the user can swap the power source without having to cut the wire.

SUMMARY OF THE INVENTION

Embodiments of the present invention solve the above-mentioned problems and provide a distinct advance in the art of cooling cases for portable electronic devices. The present invention provides a case for selectively cooling a portable electronic device via a combines a laminated graphene cooling film and gel.

Described in the present invention is a LED bulb connection mechanism that user can swap the power source without having to cut the wire or change colours through use of a pin connector.

These and other features, and advantages of the present invention will become apparent from the following detailed description, the accompanying drawings, and the appended claims.

BRIEF DESCRIPTION OF FIGURES

Embodiments of the present invention are described in detail below with reference to the attached drawing figures, wherein.

Figure 1:
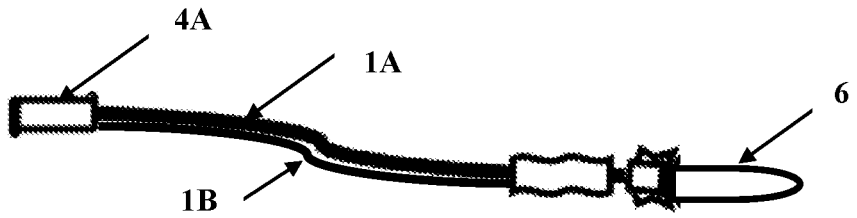
FIG. 1 is a perspective view of a connector and blue light as constructed in accordance with an embodiment of the present invention.

The drawing figures do not limit the current invention to the specific embodiments disclosed and described herein. The drawings are not necessarily to scale; emphasis instead being placed upon clearly illustrating the principles of the invention.

These and other features, and advantages of the present invention will become apparent from the following detailed description, the accompanying drawings, and the appended claims.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification.

It will be appreciated that in the development of any such actual implementation (as in any development project), design decisions must be made to achieve the designers' specific goals (e.g., compliance with system- and business-related constraints), and that these goals will vary from one implementation to another.

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included.

Thus, the current technology can include a variety of combinations and/or integrations of the embodiments described herein.

Generally, as shown in FIG. 1-4 LED bulb that can swap colours or power source through use of a pin connector 4A, 4B is disclosed. If the wiring has a pin connector the wires can be separated without having to use a tool or additional parts.

Main Component of the Invention

A. Power source 3 with wire that has connector piece at end (component A).

B. Light bulb 5,6 with wire that has connector piece at end (component B).

Relationship Between that Components

Item A and B connect together to power light bulb.

How the Invention Works

Figure 2:
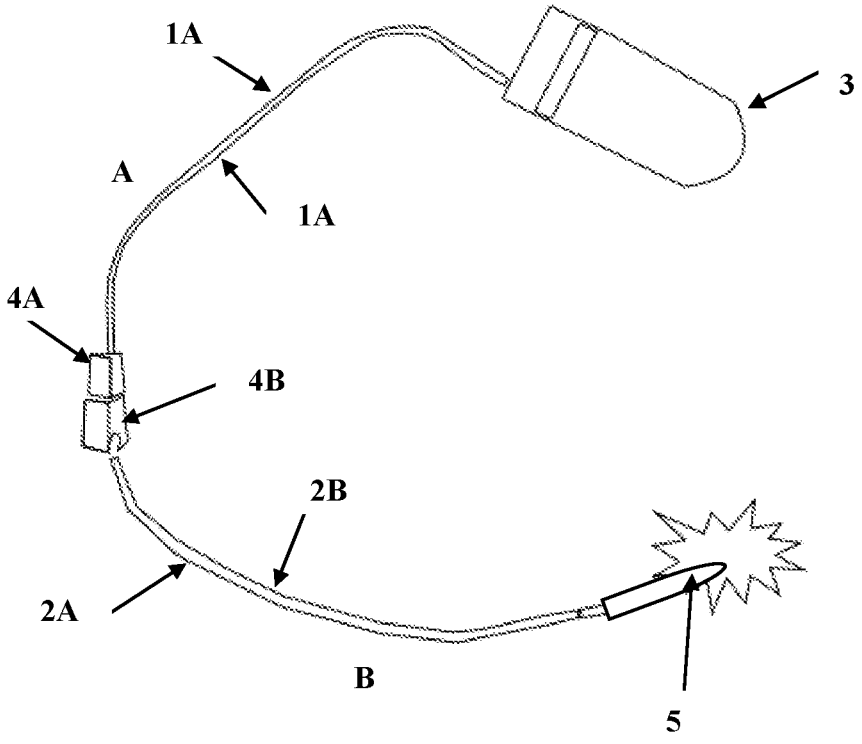
FIG. 2 is a side perspective view of the invention showing a red light generation connection involving a power source, pin connectors and red light bulb as contained therein.
Figure 3:
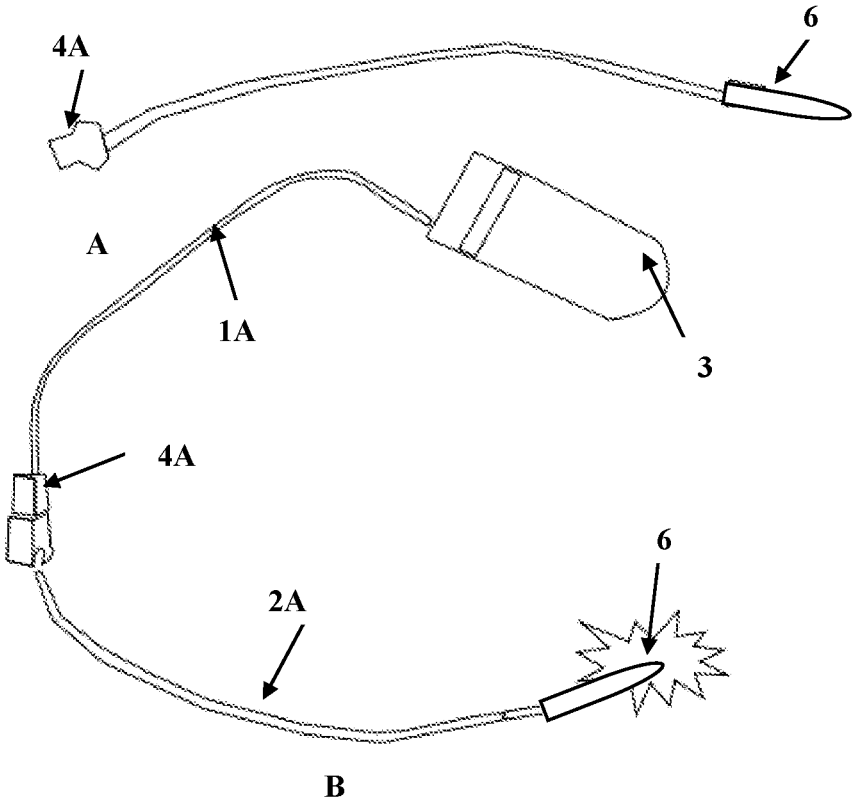
FIG. 3 is a side view of FIG. 2 showing light bulb colour having been swapped from red to blue light using pin connectors thereof.
Figure 4:
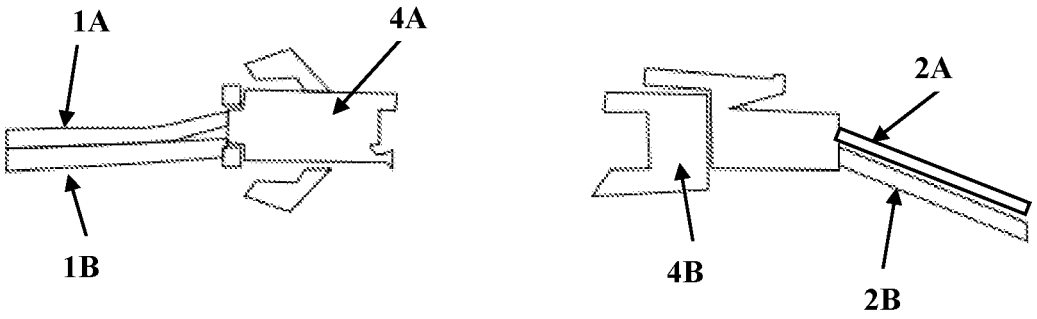
FIG. 4 is side view showing the pin connectors as described in the present invention.

Item A supplies power through wire to connector 4A, 4B. Item B receives power from item A connector and power turns on light bulb. With the use of connectors, the user can swap the power source 3 or change the LED bulb, 5, 6 without having to cut the wire, 1, 2 as shown in FIG. 2 and FIG. 3.

How to Make the Invention

Attaching a connector to end of wire of power source and attaching a connector to end of wire on light bulb and plugging the connectors together. Attaching a connector 4A, 4B to a different light bulb colour with wire will make the light bulb easy to swap.

The crucial components for this process would be to have the connector attached to a wire and different led light bulbs, allowing the device to have changeable led bulbs and colours as well as changing the power source.

How to Use the Invention

This invention would be used to have a light source that has interchangeable led light bulb, types, as well as being able to change source from battery powered to USB powered. This would be done by using connectors instead of having to fuse each wire together. For example, if a different colour is needed the user would disconnect one colour (red) and plug in a different colour (blue 06) using the pin connector.

Described in the present invention is a novel Light-Emitting Diode (LED) light bulb as an electric light that produces light using light-emitting diodes (LEDs) as shown in FIGS. 1-4.

In FIG. 1, the invention teaches of a perspective view of a connector and blue light as constructed in accordance with an embodiment of the present invention. It illustrates a LED light bulb connection, comprising a connector 4A, red cable 1A and black cable 1B and blue light bulb 6 when it is unlit.

In FIG. 2, the invention provides a side perspective view of the invention showing a red light 5 generation connection involving a power source 3, pin connectors 4A, 4B and red light bulb 5 when lit as contained therein a power source 3. The red cable 1A and black cable 1B wires constructed to connect the power source with the connector 4A. Also demonstrated by FIG. 2 is the connection between the connector 4B and the lit red bulb 5 using red cable wire 2A and black cable wire 2B, which shows the possibility of swapping coloured bulbs using pin connectors.

According to FIG. 3, the invention teaches of a side view of FIG. 2 showing light bulb colour having been swapped from red to blue light using pin connectors thereof. Here, the invention shows unlit red bulb connected to the pin via cables. It also demonstrates the electrical construction of power source 3 connected to pin 4A via red and black cable wires 1A, 1B, which are fixed to pin 4A that is in turn connected to pin 4B that enables swapping of light bulb colours at step 7 from red 5 to blue 6 via the red and black cable wires 2A, 2B.

The present invention is not limited to the embodiments described above. Various changes and modifications can, of course, be made, without departing from the scope and spirit of the present invention. Additional advantages and modifications will readily occur to those skilled in the art. Accordingly, various modifications may be made without departing from the spirit or scope of the general inventive concept as defined by the appended claims and their equivalents.

It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

To the accomplishment of the above and related objects, this invention may be embodied in the form illustrated in the accompanying drawings, attention being called to the fact. However, that the drawings are illustrative only and that changes may be made in the specific construction illustrated and described within the scope of the appended claims.

Although the invention has been described with reference to the embodiments illustrated in the attached drawing figures, it is noted that equivalents may be employed and substitutions made herein without departing from the scope of the invention as recited in the claims.

INDUSTRIAL APPLICATION

The present invention applies to light-emitting diode (LED) bulbs and in particular to light-emitting diode bulb having connectors that can enable the user to swap the power source or change the light LED bulb without having to cut the wire. LED lamps are used for both general and special-purpose lighting. Where colored light is needed, LEDs that inherently emit light of a single color require no energy-absorbing filters. LED lamps are commonly available as drop-in replacements for either bulbs or fixtures, replacing either an entire fixture (such as LED light panels replacing fluorescent troffers or LED spotlight fixtures replacing similar halogen fixtures) or bulbs (such as LED tubes replacing fluorescent tubes inside troffers or LED HID replacement lamps replacing HID bulbs inside HID fixtures) The differences between replacing a fixture and replacing a bulb are that, when a fixture (like a troffer) is replaced with something like an LED panel, the panel must be replaced in its entirety if the LEDs or the driver it contains fail since it is impossible to replace them individually in a practical fashion (although the driver is often separate and so it may be replaced), whereas, if only the bulb is replaced with an LED replacement lamp, the lamp can be replaced independently of the fixture should the lamp fail. Some LED replacement lamps require the fixture to be modified such as by electrically removing the fixture's ballast, thus connecting the LED lamp directly to the mains supply; others can work without any modifications to the fixture.

What is claimed is:

1. A light-emitting diode (LED) bulb comprising:

a power source attached via a first wired connection to a first connector, wherein the first wired connection comprises a first set of wires; and a light bulb attached via a second wired connection to a second connector wherein the second wired connection comprises a second set of wires;

wherein the first connector and the second connector are configured to be removably connected to each other through a first set of pin and cables of the first connector and a second set of pin and cables of the second connector.

2. The LED bulb of claim 1, wherein the power source is positioned on a first end of the first wired connection, and the first connector is positioned on the opposite end of the first set of wires.

3. The LED bulb of claim 2, wherein the light bulb is positioned on a first end of the second wired connection and the second connector is positioned on the opposite end of the second set of wires.

4. The LED bulb of claim 3, wherein the said electrical construction is designed in such a way that if the wiring has a pin connector, the wires can be separated without having to use a tool or additional parts.

5. The LED bulb of claim 2, wherein the two components are enabled to connect together to power light bulb, wherein:

the power source component supplies power through wire to connector; and the light bulb component receives power from item #1 connector and power turns on light bulb.

6. The LED bulb of claim 5, wherein the with the use of connectors, the user is able to swap the power source or change the light LED bulb without having to cut the wire.

7. A light-emitting diode (LED) bulb comprising:

a power source; and a light bulb connected to the power source through a pin and cables;

wherein a connection is made between the power source and the light bulb, by attaching a connector to an end of a wire of the power source and attaching a connector to an end of a wire on the light bulb and plugging the connectors together.

8. The LED bulb of claim 7, wherein the attaching a connector to a different light bulb colour with wire makes the light bulb easy to swap.

9. The LED bulb of claim 8, wherein the by attaching the connector to a wire and different led light bulbs allows the device to have changeable led bulbs and colours as well as changing the power source.

10. The LED bulb of claim 9, wherein the connection is used to have a light source that has interchangeable led light bulb, types, as well as being able to change source from battery powered to USB powered.

11. The LED bulb of claim 10, wherein the connectors are used instead of having to fuse each wire together to get a different colour.

12. The LED bulb of claim 1, wherein the second connector is configured to:

receive the first connector; and transfer electrical current from the power source, through a connection facilitated by the first and second connector connection, to the LED bulb.

13. The LED bulb of claim 12, wherein the second connector is configured to receive a different first connector interconnected with a different LED bulb, wherein the different LED bulb is a different color from the LED bulb.

14. The LED bulb of claim 1, wherein the first connector comprises a first locking clip and a second locking clip, wherein the first and second locking clips are configured to be removably attached to a first receptor and a second receptor of the second connector, each of the first and second locking clips configured to attach the first connector internally to the second connector.

* * * * *